US011167892B2

(12) United States Patent
Hart

(10) Patent No.: US 11,167,892 B2
(45) Date of Patent: Nov. 9, 2021

(54) COLLAPSIBLE LEAKPROOF CONTAINER

(71) Applicant: H2Armor, Inc., Seattle, WA (US)

(72) Inventor: Brian Hart, Seattle, WA (US)

(73) Assignee: H2Armor, Inc., Seattle, WA (US)

( * ) Notice: Subject to any disclaimer, the term of this patent is extended or adjusted under 35 U.S.C. 154(b) by 0 days.

(21) Appl. No.: 16/816,070

(22) Filed: Mar. 11, 2020

(65) Prior Publication Data

US 2020/0317407 A1 Oct. 8, 2020

Related U.S. Application Data

(60) Provisional application No. 62/828,130, filed on Apr. 2, 2019, provisional application No. 62/838,230, filed on Apr. 24, 2019, provisional application No. 62/931,710, filed on Nov. 6, 2019.

(51) Int. Cl.

| | |
|---|---|
| ***B65D 33/24*** | (2006.01) |
| ***B65D 43/02*** | (2006.01) |
| ***A45C 13/00*** | (2006.01) |
| ***B65D 33/25*** | (2006.01) |

(52) U.S. Cl.

CPC ..... *B65D 43/0229* (2013.01); *A45C 13/008* (2013.01); *B65D 33/24* (2013.01); *B65D 33/25* (2013.01); *B65D 2251/20* (2013.01)

(58) Field of Classification Search

CPC .... B65D 43/0229; B65D 33/24; B65D 33/25; B65D 2251/20; A45C 13/008

USPC ..... 383/59

See application file for complete search history.

(56) References Cited

U.S. PATENT DOCUMENTS

| | | | | |
|---|---|---|---|---|
| 3,948,436 | A | 4/1976 | Bambara | |
| 4,144,607 | A * | 3/1979 | Soubie | B63C 9/1255 441/114 |
| 4,421,150 | A | 12/1983 | Masters | |
| 5,816,709 | A | 10/1998 | Demus | |
| 5,931,583 | A | 8/1999 | Collie | |
| 5,935,882 | A * | 8/1999 | Fujita | A41D 31/065 442/247 |
| 5,938,095 | A | 8/1999 | Haar et al. | |
| 6,149,305 | A | 11/2000 | Fier | |
| 6,267,506 | B1 | 7/2001 | Campion | |
| 6,675,998 | B2 * | 1/2004 | Forsman | A45F 3/20 215/306 |
| 8,302,749 | B2 | 11/2012 | Melmon et al. | |

(Continued)

FOREIGN PATENT DOCUMENTS

| | | |
|---|---|---|
| CN | 2829677 Y | 10/2006 |
| JP | 3071081 U | 8/2000 |
| JP | 3124939 U | 8/2006 |

OTHER PUBLICATIONS

International Search Report and Written Opinion for PCT/US2020/026029, dated Jul. 20, 2020, 13 pages.

*Primary Examiner* — Peter N Helvey

(57) ABSTRACT

A collapsible leakproof container comprises an orifice ring defining a mouth of the container, a lid that detachably seals with the orifice ring, a flexible body coupled to the orifice ring, the flexible body having at least an outer layer a waterproof barrier layer disposed inside the outer layer and sealed to the orifice ring, and a puncture resistant layer disposed between the waterproof layer and an interior of the flexible body. Such a container is helpful for transporting fragile vessels such as wine while travelling.

18 Claims, 7 Drawing Sheets

(56) References Cited

U.S. PATENT DOCUMENTS

| | | | | |
|---|---|---|---|---|
| 2003/0106895 | A1 | 6/2003 | Kalal | |
| 2005/0072181 | A1* | 4/2005 | Mogil | B65D 81/3858 62/457.7 |
| 2008/0116101 | A1 | 5/2008 | Snyder | |
| 2009/0039119 | A1 | 2/2009 | Dias et al. | |
| 2009/0266722 | A1* | 10/2009 | Rogers | B65D 5/643 206/216 |
| 2011/0069909 | A1 | 3/2011 | Beene et al. | |
| 2014/0254956 | A1 | 9/2014 | Buell, III | |

* cited by examiner

COLLAPSIBLE LEAKPROOF CONTAINER

CROSS REFERENCE TO RELATED APPLICATIONS

This application is a nonprovisional claiming priority to U.S. Provisional Patent Applications 62/828,130, filed Apr. 2, 2019, 62/838,230, filed Apr. 24, 2019, and 62/931,710, filed Nov. 6, 2019, which are incorporated by reference herein for all purposes.

BACKGROUND

As wineries and craft distilleries become more popular, it is increasingly common for travelers to purchase bottles of alcohol at a remote destination and transport the alcohol home for later consumption. However, transporting fragile alcohol bottles presents several problems for a traveler. If a bottle is placed in luggage, breaking the bottle results in the loss of the bottle's contents and may destroy other items within the luggage as well. For example, a broken bottle of wine could potentially ruin clothing and electronic devices that are stored within the same piece of luggage.

There are many known devices for transporting wine bottles and other fragile vessels containing fluids that are intended to protect the contents within the device. Some of the existing solutions rely on air cushions, or a "bubble wrap" style of impact protection, while others use a rigid foam material, e.g. Styrofoam, that is cut in the shape of a bottle. Such solutions occupy a relatively large amount of space, which is impractical for travel, and are often treated as disposable articles. Furthermore, such devices are not typically sealed, so the contents of a broken bottle could leak out and damage surrounding materials.

Other devices employ a padding material or an inflatable cushion of air for impact resistance with or without a waterproof closure system. When the vessel is a hard material that shatters when broken, the broken parts of the vessel may perforate the otherwise waterproof seal of existing devices, potentially destroying the contents of a suitcase.

There are known hard cases for bottle and vessel protection that offer superior impact resistance and significantly decrease damage to a bottle or vessel. However, these are inconveniently bulky and are not practical for a traveler to carry within luggage when not in use.

Conventional soft, flexible bottle carriers lack cut and puncture resistance. In the event of bottle breakage these containers are easily perforated by broken glass, allowing the enclosed liquid to leak, which can damage surrounding personal articles when, for example, the carrier is stored in a user's luggage.

A need therefore exists for a flexible, compact protective container with puncture-resistant qualities to protect the surrounding environment from contamination and damage.

TECHNICAL FIELD

Embodiments of the present disclosure relate to a portable leak-resistant container, and, more particularly, to a collapsible container suitable for protecting an enclosed bottle of wine, spirits, or any other liquid, gel, or semi-solid from damage. The container prevents the escape of a broken container's contents in the event of such damage.

BRIEF SUMMARY

The present disclosure describes a container that can be used as a travel bag for bottles of wine and spirits and other glass vessels and minimize the chance of leakage by protecting the vessel from impacts, providing a robust seal, and protecting a waterproof layer from damage from a broken vessel. Embodiments of the present disclosure include a bag possessing both a waterproof resealable opening and at least one layer of puncture-resistant material within the bag to protect bag integrity to retain any liquids, gels, or semi-solids that may escape from a broken bottle or vessel within, and one or more energy-absorbing material that may prevent damage. Embodiments of the present application may be useful for transporting bottles of wine or spirits, containers of hazardous or biological materials, ceramic food containers, glass or ceramic vessels that contain fine powders, or any other fragile vessels without limitation. In one specific embodiment, the container is shaped to accept a conventional bottle of wine or spirits, and is configured to be stored compactly when not in use.

In an embodiment, a collapsible leakproof container includes an orifice ring defining a mouth of the container, a lid that detachably seals with the orifice ring, and a flexible body coupled to the orifice ring, the flexible body including an outer layer, a waterproof barrier layer disposed inside the outer layer and sealed to the orifice ring, and a puncture resistant layer disposed between the waterproof layer and an interior of the flexible body. The flexible body further may include an energy absorbing layer, which may be an open cell viscoelastic foam.

The leakproof container may have an inner lining layer as an innermost layer. An upper edge of the energy absorbing layer may be disposed below a lower surface of the orifice ring. The flexible body may be divided into 1) a body portion that comprises the energy absorbing layer, a first liner layer and the puncture resistant layer, and 2) a binding portion that comprises a second puncture resistant layer and is joined to the body portion. The body portion further may include a first liner layer as an innermost layer.

In an embodiment, the binding portion is retained to the orifice ring by one or more compression band, and the binding portion is joined to the body portion by at least one of a stitching and an adhesive. The puncture resistant layer may include an aramid or para-aramid polymer, and in an embodiment the puncture resistant layer is an aramid or para-aramid felt.

In an embodiment, a channel is disposed on an outer surface of the orifice ring, and at least one layer of the flexible body is retained in the channel by at least one compression band. The container may include a cover ring that covers the channel and the at least one compression band.

In an embodiment, the container has a first seal that seals the lid to the orifice ring, and a second seal that seals the waterproof barrier layer to the orifice ring. The waterproof barrier layer may be compressed by the second seal.

In an embodiment, a container includes an elastomeric sealing element and a cover ring coupled to the orifice ring and covering a free end of the waterproof barrier layer, wherein the waterproof barrier layer is disposed over the elastomeric sealing element, and the elastomeric sealing element is compressed between the cover ring and the orifice ring. The orifice ring may have a shoulder that extends outward from the mouth and protrudes further than the sidewalls forming the channel, and the cover ring may be coupled to a lower surface of the shoulder.

In an embodiment, the leakproof container has a cylindrical shape and the orifice ring is disposed at one end of the cylindrical shape. The container may further comprise a strap configured to retain the flexible body in a collapsed state, and the flexible body may be flexible enough to be folded in half.

BRIEF DESCRIPTION OF THE DRAWINGS

The following figures illustrate exemplary embodiments of the present disclosure. In particular.

DETAILED DESCRIPTION

A detailed description of embodiments is provided below along with accompanying figures. The scope of this disclosure is limited only by the claims and encompasses numerous alternatives, modifications and equivalents. Although steps of various processes are presented in a particular order, embodiments are not necessarily limited to being performed in the listed order. In some embodiments, certain operations may be performed simultaneously, in an order other than the described order, or not performed at all.

Numerous specific details are set forth in the following description in order to provide a thorough understanding. These details are provided for the purpose of example and embodiments may be practiced according to the claims without some or all of these specific details. For the sake of clarity, technical material that is known in the technical fields related to this disclosure has not been described in detail so that the disclosure is not unnecessarily obscured.

Figure 1:
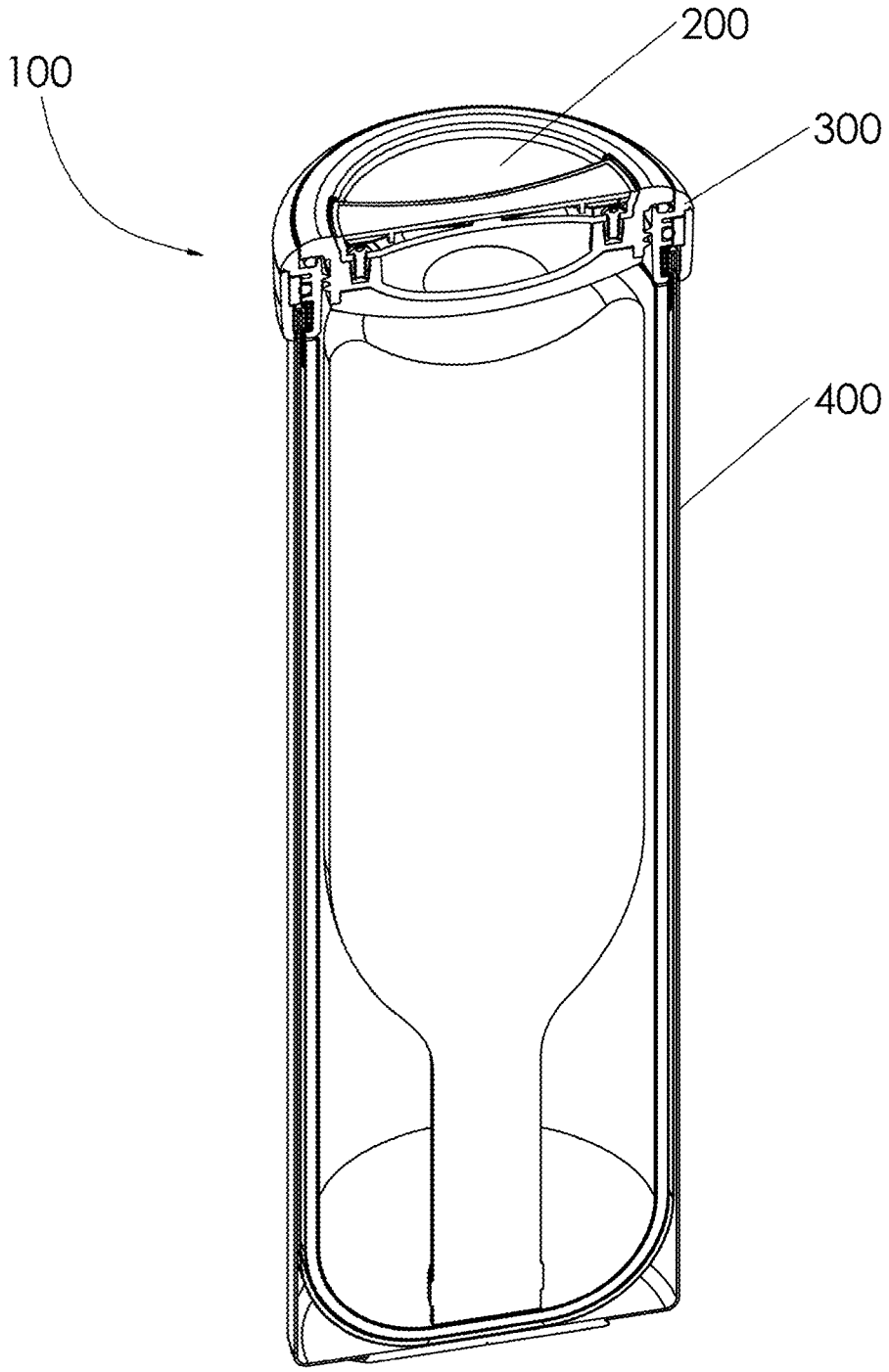
FIG. 1 illustrates a cross-sectional view of a container with a wine bottle.

FIG. 1 illustrates an embodiment of a collapsible leakproof container 100. The embodiment shown in FIG. 1 comprises a lid 200 that attaches to an orifice ring 300. The orifice ring 300 is attached to a flexible body 400. The body may be sufficiently flexible to be collapsed into a flattened shape, effectively removing the free space that would otherwise be present in an empty container.

The ability of the container 100 to collapse is useful to reduce the volume of an empty container 100 during transportation. In some embodiments, the flexible body 400 is flexible enough to be rolled into a highly compact shape, and may have compressible elements that can be mechanically compressed to minimize the space occupied by an empty container 100. In some embodiments, the flexible body 400 is maintained in a compressed state by an external or integrated strap 600.

In an embodiment, the container 100 has a size that accommodates standard 750 ml wine bottle shapes. For example, the container 100 may have a size that accepts the following wine bottle types: the split, the Bordeaux, the California red, the Burgundy, the Riesling, and the standard/small Champagne bottles. The size may be adapted to accommodate a particular fluid vessel or class of vessels. For example, even though the figures of the present disclosure illustrate an embodiment that is adapted for wine bottles for wine and spirit bottles, embodiments can be useful for transporting other fragile fluid containers as well, such as containers of distilled spirits, beer, perfume, dyes, hazardous materials, and other fluids that are stored in glass or ceramic containers. Accordingly, dimensions of the orifice ring 300 and container may change in embodiments that are adapted for different types of vessels.

The container 100 has a number of advantages not found in conventional containers. Container 100 combines properties of portability, leakproofness, light weight and protection, resulting in a container that is especially well suited for travelling and transporting a fragile vessel. The combination of layers in the flexible body 400 may balance puncture resistance, shock resistance, absorbency and waterproofness to prevent leaks while maintaining compressibility for compact storage. In addition, the flexible body 400 may have thermally insulative qualities, which can be useful to keep a wine chilled or protect it from excessive heat over brief periods.

Embodiments of the present disclosure have been shown to have an excellent combination of these properties. Experimentation has established that embodiments maintain structural integrity even when exposed to impacts that pulverize a wine bottle. Specifically, a wine bottle was placed within a container 100 according to an embodiment of the present disclosure, and the container 100 was placed within a concrete mixer for three hours. Even though the impact from the tumbling was sufficient to break the glass of the wine bottle into fine particles, no fluid was released from the container, establishing that embodiments of the present disclosure have an exceptional combination of properties. Nevertheless, particular embodiments may be configured to emphasize one or more of these properties for specific applications—for example, an embodiment may comprise a thinner layer of puncture resistant material to reduce weight and increase flexibility. Accordingly, even though the specific embodiments that are described by this disclosure provide an excellent combination of properties, numerous variations are possible.

Figure 2A:
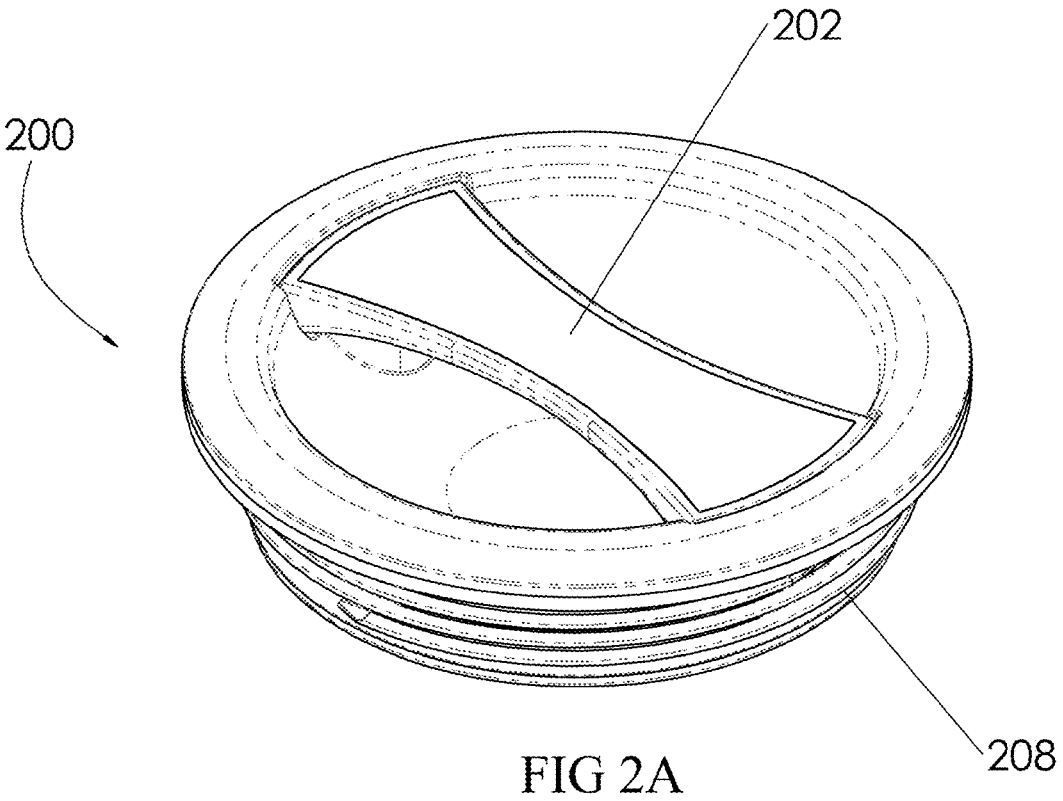
FIGS. 2A and 2B are isometric and cross-sectional views of a lid 200, respectively.
Figure 2B:
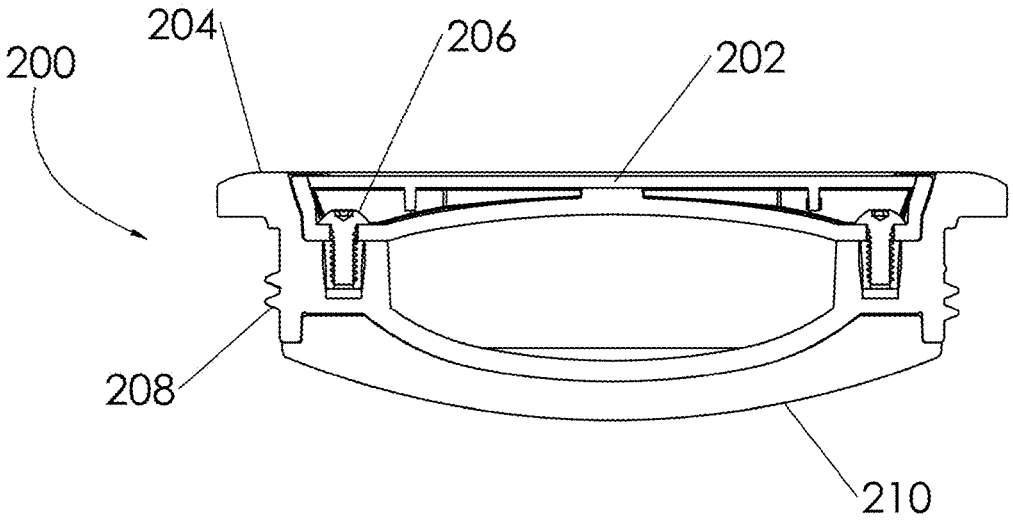

FIGS. 2A and 2B are isometric and cross-sectional views of a lid 200, respectively. As seen in FIG. 2A, the lid 200 has a handle 202 that is recessed from the upper plane 204 of the lid, so that the outer rim of the lid is a flat planar surface without any elements that protrude above the plane. The upper plane 204 of the lid can be helpful so that the container 100 can stably rest on a surface in an upright position. This feature allows a user to set down a container 100 that contains a fragile vessel on a surface such as a table. The lid side of the container 100 may have a higher mass than the opposite side, which makes the upper plane 204 of the lid more advantageous as a resting surface.

In some embodiments, material of the upper plane 204 of the lid 200 is softer than materials used for other parts of the lid. For example, the lid 200 may be an injected molded article that has a co-molded elastomeric part disposed around the outer rim of the lid. An elastomeric surface may absorb impact when placing a container 100 that contains a vessel on a resting surface, and accommodate deviations in the resting surface to stabilize the container 100.

The body of the lid 200 may comprise a rigid material such as a metal or polymeric material. A few non-limiting example materials are aluminum, steel, polycarbonate, nylon, ABS, and olefinic polymers.

Although the handle 202 of the embodiment of lid 200 shown in FIG. 2A is attached to the body of the lid with two screws 206, the handle 202 may be attached to the body by another mechanism such as an adhesive bond. In an embodiment, the handle 202 is integrated into the lid 200 and not a separately attached element.

The lid 200 may include threads 208 on an exterior surface that are configured to be threaded into orifice ring 300 to create a leakproof seal. In other embodiments, the lid 200 may be sealed to the orifice ring 300 by a mechanical element such as a locking latch or strap. In such embodiments, an elastomeric surface may be present at an exterior surface of the lid 200 in place of the threads 208, and the lid may be tapered to promote a seal with the orifice ring 300.

A bumper 210 may be present on an interior-facing surface of the lid 200. The bumper may include a low-durometer elastomeric material that absorbs impacts from a vessel when the container 100 is jostled, thereby reducing the chance of breaking a vessel during transportation. Additional possible materials for a bumper 210 include rubber, cork, gel, foam, and other soft materials.

In addition to providing an impact-absorbing surface that reduces the likelihood of breaking a fragile vessel, the bumper 210 may be configured to reduce the probability that a sharp fragment from a broken vessel damages the lid or the assembly around the lid. In an embodiment, the bumper 210 may cover a majority of the inner diameter of the orifice ring 300, and the bumper 210 may extend to seal with the inner diameter of the orifice ring 300. The bumper 210 may comprise an absorbent material such as a foam or felt material that absorbs fluids to reduce the probability of a fluid leaking out of the container 100.

As seen in FIG. 2A, the bumper 210 may cover the entire lower surface of the lid 200. In other embodiments, the bumper 210 may only cover protruding parts of the lid 200, or parts of the lid 200 that are expected to impact with a particular vessel such as a wine bottle.

In some embodiments, the lid 200 further comprises a sealing element. In the embodiments shown in FIG. 4, a watertight seal between the lid 200 and the orifice ring 300 is facilitated by a separate elastomeric sealing element 312. In another embodiment, a sealing element may be co-molded with or otherwise coupled to the body of the lid 200 at a point of contact between the lid and the orifice ring 300.

Figure 3:
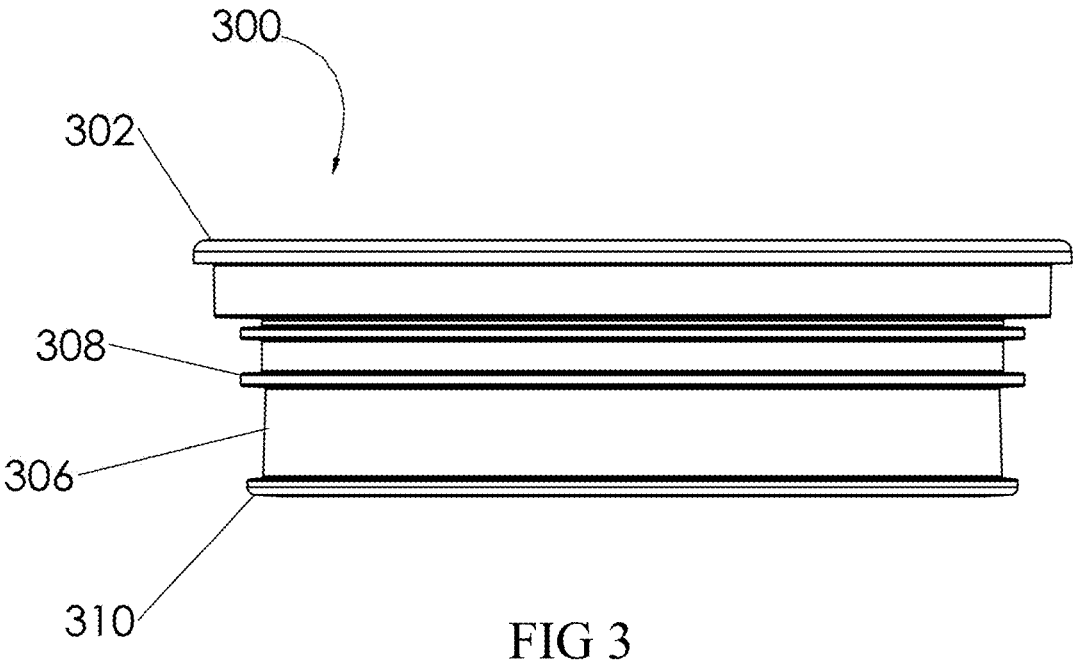
FIG. 3 illustrates an outer ring.
Figure 4:
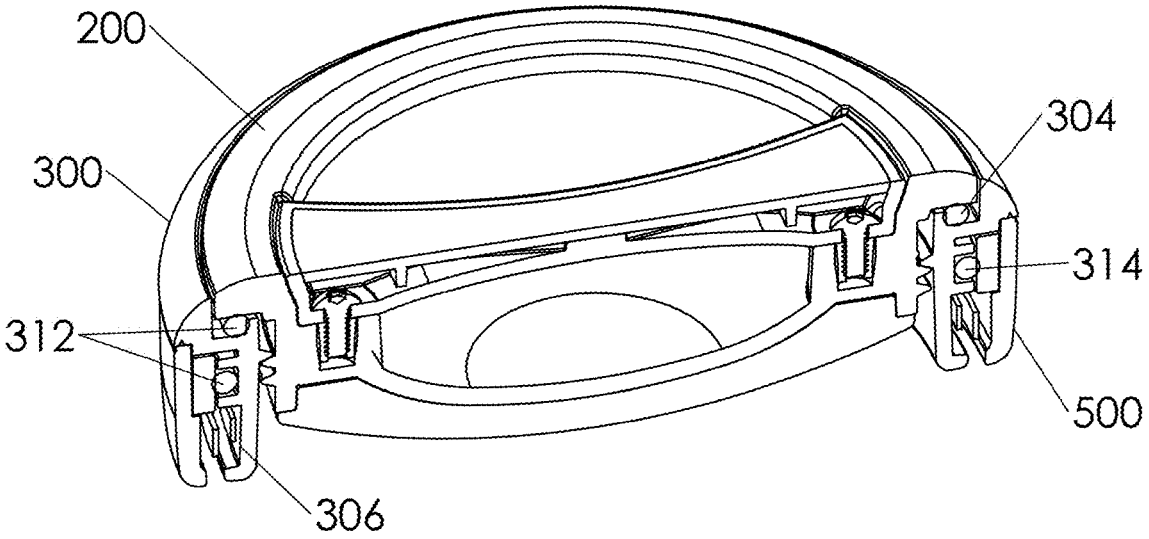
FIG. 4 illustrates an assembly including the lid and the outer ring.

FIG. 3 shows an embodiment of an orifice ring 300, and FIG. 4 shows a cross-sectional view of an assembly that includes an orifice ring 300, a lid 200, and an outer cover 400. The orifice ring 300 defines a mouth or opening of container 100 through which a vessel may be inserted. The orifice ring 300 may comprise a rigid material similar to the rigid materials of the lid, e.g. a polymer or metal material.

The embodiment of orifice ring 300 shown in FIG. 3 has a shoulder 302 that extends across an upper surface of the ring 300 and protrudes outwards as the widest point of the ring. A first seal 304 is disposed below the shoulder 302, and a channel 306 is disposed below the first seal 304. In the embodiment of FIG. 3, channel 306 is defined by a gap between first protrusion 308 and second protrusion 310 which extend outward from the lower portion of the orifice ring 300. The shoulder 302 extends further outward than the first and second protrusions 308 and 310.

In the embodiment shown in FIG. 4, first seal 304 includes an elastomeric sealing element 312 that is an O-ring confined by a channel on an upper surface of the orifice ring 300. In other embodiments, first seal 304 may include an elastomeric sealing element 312 of a different shape, e.g. a ring with a square or rectangular profile or an inelastic material such as an adhesive. The elastomeric sealing element 312 of first seal 304 may be coupled to the body of orifice ring 300 by an adhesive bond or an interference fit, and may be integrated with the orifice ring 300 by a co-molding process.

FIG. 4 shows a second seal 314 between inner fabric layers and exterior fabric. Second seal 314 seal prevents liquid that has filtered or soaked through inner fabric layers from escaping and soaking outer layers of the bag, and subsequently escaping the container. There are two ways for liquid to escape from inside the container—the first being from where the lid 200 attaches to the flexible body 400, which is sealed by first seal 304. The second way is for liquid to soak through and escape from the flexible body, which is sealed by second seal 314. In the embodiment of FIG. 4, the second seal 314 includes an elastomeric sealing element 312 in the form of an O-ring that is confined by a channel in orifice ring 300. In other embodiments, the elastomeric sealing element 312 may have a different shape and be attached to the body orifice ring 300 in the same ways as the elastomeric sealing element 312 discussed above with respect to the first seal 304. In other embodiments, as discussed above with respect to the lid 200, the elastomeric element sealing element 312 of the second seal 314 may be attached to or integrated with the lid 200. In such an embodiment, the first protrusion 308 may correspond to the lower surface of the elastomeric sealing element 312.

Figure 5:
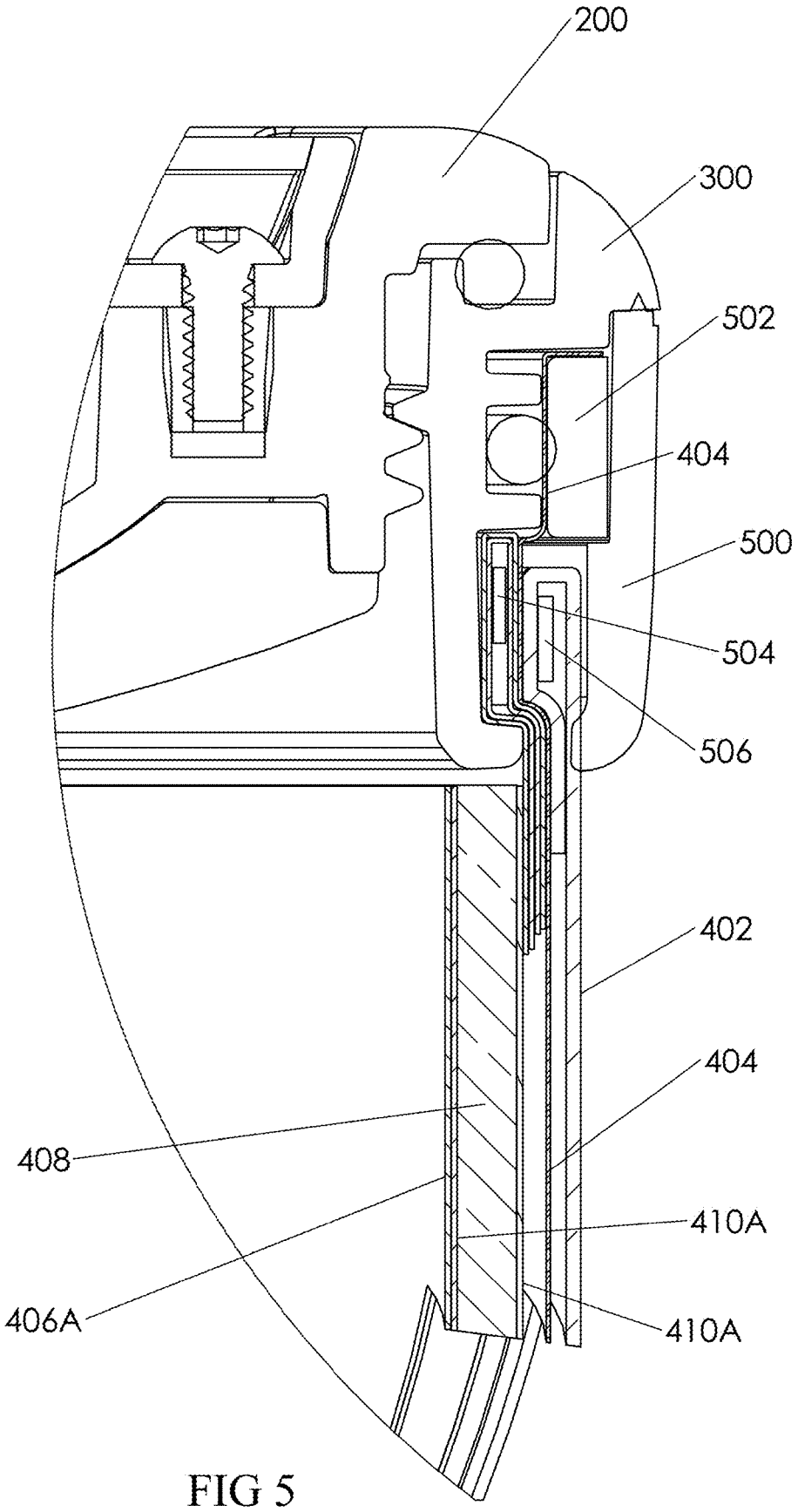
FIG. 5 illustrates a cross-sectional view of an assembled container.

FIG. 5 is a cross-sectional view of a container 100 that shows an embodiment of the interface between the orifice ring 300 and various layers of the flexible body 400. In the embodiment of FIG. 5, layers of the flexible body 400 are retained within the channel 306 of outer ring 300, and retaining members are covered by a cover ring 500. Cover ring 500 may be a ring of polymeric or metal material that is coupled to a lower surface of the shoulder portion 302 of outer ring 300. The cover ring 500 may be coupled to the orifice ring 300 by an adhesive bond, solvent bond, interference fit, ultrasonic weld, etc.

Also shown in FIG. 5 is a seal ring 502 that is disposed in and may fill a gap between the inner surface of cover ring 500 and an outer protruding surface of the first protrusion 310 of orifice ring 300. Accordingly, the combination of the cover ring 500, seal ring 502 and orifice ring 300 may provide a strong rigid assembly. In addition, the seal ring 502 may compress the elastomeric sealing element 312 of the first seal 304.

In an embodiment, the waterproof barrier layer 404 is routed between the second seal 314 and the seal ring 502, thereby providing a thorough watertight seal between layers of the flexible body and the orifice ring 300. In addition, the waterproof barrier layer 404 may be disposed between an upper surface of the seal ring 502 and a lower surface of the shoulder 302 of orifice ring 300.

Although FIG. 5 shows seal ring 502 as being a separate component from cover ring 500, in some embodiments seal ring 502 is integrated into a single body with cover ring 500. When the seal ring 502 and cover ring 500 are separate components, seal ring 502 may be compressed or retained between cover ring 500 and the shoulder 302 by a step protruding from the inner surface of cover ring 500.

Layers of the fabric body 400 may be coupled to the orifice ring 300 by one or more compression bands that are disposed within the channel 306. In an embodiment, one or more of the waterproof barrier layer 404, liner layer 406, energy absorbing layer 408, puncture resistant layer 410 and second liner layer 412 are retained by a first compression band 504, and one or more of those layers may be retained by a second compression band 506 that also retains the outer layer 402. The compression bands 504 and 506 may be elastic materials, heat shrink materials, or mechanical components such as zip ties or ring clamps that apply compression to a cylindrical body.

Many embodiments are possible for retaining the flexible body materials. For example, in an embodiment, only one compression band is present. In some embodiments, layer retention is facilitated at least in part by an adhesive.

In order to accommodate the compression bands, loops and multiple layers, a gap is present between the cover ring 500 and channel 306. Such a gap may be greater than a gap between the second protrusion 310 and the orifice ring 300. The cover ring 500 covers the compression bands, thereby protecting the retention of the flexible body layers to the orifice ring and providing a pleasing aesthetic appearance.

FIG. 5 illustrates one embodiment of material layers that may be present in a flexible body 400. FIG. 5 merely shows one possible order of material layers, and the thicknesses of the figure are presented for clarity of illustration.

The outermost layer of the flexible body 400 is outer layer 402. Outer layer 402 may comprise a material with a desirable aesthetic appearance, such as leather, fabric or canvas. In some embodiments, the outer layer has additional properties that contribute to leakproofness by providing one or more of abrasion resistance, puncture resistance, a waterproof seal, and energy absorption. In some embodiments, the outer layer 402 comprises multiple materials to enhance properties of the container 100. For example, outer layer 402 may include a ballistic nylon that is coated with an impermeable polyurethane. In another embodiment, the outer layer 402 may be an 18 oz waxed cotton twill fabric. Some of the properties of the outer layer 402 may include abrasion and puncture resistance to protect the underlying waterproof barrier layer 404, and strength to support carrying straps and the weight of a wine bottle.

A waterproof barrier layer 404 is disposed under the outer layer 402. The waterproof barrier layer 404 may provide waterproof barrier properties that prevent the passage of liquids and gas. Accordingly, the waterproof barrier layer 404 may comprise a solid polymer material such as polyurethane or polyethylene, and may have a thickness from 0.003 to 0.010 inches. The waterproof barrier layer 404 may be a polymer with material properties that provide waterproofness and tear resistance at relatively low thickness to minimize weight while maintaining flexibility. In some embodiments, the waterproof barrier layer may provide other waterproof barrier properties such as chemical waterproof barrier properties.

In an embodiment, waterproof barrier layer 404 comprises a sheet of polymer that is cut and folded into a cylindrical shape, and the seams creating the cylindrical shape are welded or adhesive bonded to form a bag-shaped article with a leakproof seal. The waterproof barrier layer 404 may be sealed on one end and open on an opposite end. In another embodiment, the waterproof barrier layer 404 is a net-shape molded article.

The waterproof barrier layer 404 may be bonded to one or more adjacent layer of the flexible body 400, and in some embodiments, at least a portion of waterproof barrier layer 404 is coated onto an adjacent layer. In some embodiments, the waterproof barrier layer 404 may include multiple discrete material layers, which may be co-extruded or coated to form one or more separate layer of material. When a seam is present in the waterproof barrier layer 404, the seam may be configured so that the raw edges of the seam are directed towards the exterior of the container 100, and the smooth side of the seam faces the interior.

The flexible body 400 may further comprise a liner layer 406, which may be adjacent to waterproof barrier layer 404. In some embodiments, waterproof barrier layer 404 is a discrete layer that has a high friction or sticky feeling surface. Accordingly, a liner layer 406 may reduce the probability that waterproof barrier layer 404 would bunch up against an adjacent layer, which could lead to damage when the container 100 is collapsed for compact storage. The liner layer may comprise a polymer material such as nylon or polyethylene, and may be a fabric or a sheet. Example materials include a nylon fabric, a polyester fabric such as a micro-suede, and a UHMWPE material. Multiple liner layers 406 may be present, e.g. first liner layer 406A and second liner layer 406B, and thicknesses may be from 0.005 to 0.030.

When the liner layer 406 is a woven fabric layer, the woven fabric may be coated with a material having waterproof barrier properties. Examples of such materials include a urethane laminate, a fluoropolymer such as PTFE, and a PVA material. In some embodiments, the liner layer 406 may be a metallized polymer for enhanced waterproof barrier properties.

The flexible body 400 may further comprise an energy absorbing layer 408 that absorbs impacts to protect a vessel from being broken, and to prevent shards from a broken vessel from penetrating other layers of the flexible body 400, including the waterproof barrier layer 404. In various embodiments, energy absorbing layer 408 may comprise a foam material, or a relatively soft and compressible material such as an elastomer sheet or gel.

In an embodiment, energy absorbing layer 408 comprises a viscoelastic open celled foam. Viscoelastic open cell foam materials have so-called memory properties that are exemplified by temporarily retaining a deformed shape, which can be helpful to retain a collapsed shape when the container 100 is being transported. In particular, shape retention can be helpful to hold the flexible body 400 in a compressed shape while a user is attaching a strap to compress the body or retain the shape. In a specific embodiment, energy absorbing layer 408 is a PORON® XRD open cell foam material.

When energy absorbing layer 408 is a memory foam material, the memory foam may have a density between 5 and 15 pounds per cubic foot (PCF). Memory foams within this density range have a good balance of collapsibility and energy absorption. The energy absorbing layer 408 may have a thickness of from 2 to 4 mm to achieve a desirable balance of flexibility and energy absorption. A memory foam returns to its original shape after compression, and will not leave a crease in the foam when the product is folded onto itself. A crease could distort the cell structure of the foam and decrease impact resistance.

A foam energy absorbing layer 408 may have a secondary benefit of being absorptive, which can enhance the leakproofness of a container 100. Still another benefit of the energy absorbing layer 408 is resilience, which can contribute to puncture resistance of the container 100.

The flexible body 400 may further comprise one or more puncture resistant layer 410. A puncture resistant layer 410 may be disposed inside of the waterproof barrier layer 404 to reduce the possibility that a shard of glass from a broken vessel penetrates the waterproof barrier layer 404. In addition, the puncture resistant layer 410 may be disposed inside of the energy absorbing layer 408, so that the energy absorbing layer 408 can deflect to increase the rate at which energy is transferred from a broken shard to the puncture resistant layer 410. Put another way, energy absorbing layer 408 can soften the blow of a shard on the puncture resistant layer 410, reducing the slope of an elastic curve for a transference of force from a broken shard.

The puncture resistant layer 410 may comprise a flexible puncture resistant material such as an aramid or para-aramid polymer, a high molecular weight polyethylene polymer, a fiberglass material, etc. The puncture resistant layer 410 may have an ANSI/ISEA 105-2016 puncture resistance that is level 4 or greater, and cut protection that is level A2 or greater. In an embodiment, puncture resistance is at least level 5, and cut protection is at least level A3-however, embodiments are not limited to these levels. Example materials include KEVLAR® woven and felt materials, other felt fabrics, e.g. wool and synthetic felt materials including aramid felt. In a specific embodiment, puncture resistant layer 410 comprises a CUTPRO® material by Norfab, Inc., which is formed from twill woven from aramid base materials. Some materials for puncture resistant layer 410 may not be tightly bound, so a liner layer 406 may provide desirable fabric properties to an assembly. In an embodiment, one or more puncture resistant layer 410 is laminated to energy absorbing layer 408, and the laminate material may provide excellent cut resistance and puncture resistance. Thicknesses of puncture resistant layer 410 may be from 0.010 to 0.040 inches, and energy absorbing layer may be from 0.05 to 0.15, or 0.12 to 0.08 inches with a density of 80-120 gsm.

A polymer felt material may have additional benefits to promote leakproofness of the container 100. Specifically, felt materials may be compressible to assist with energy absorption, and may absorb liquid, reducing the amount of free fluid present from a leak.

Figure 6:
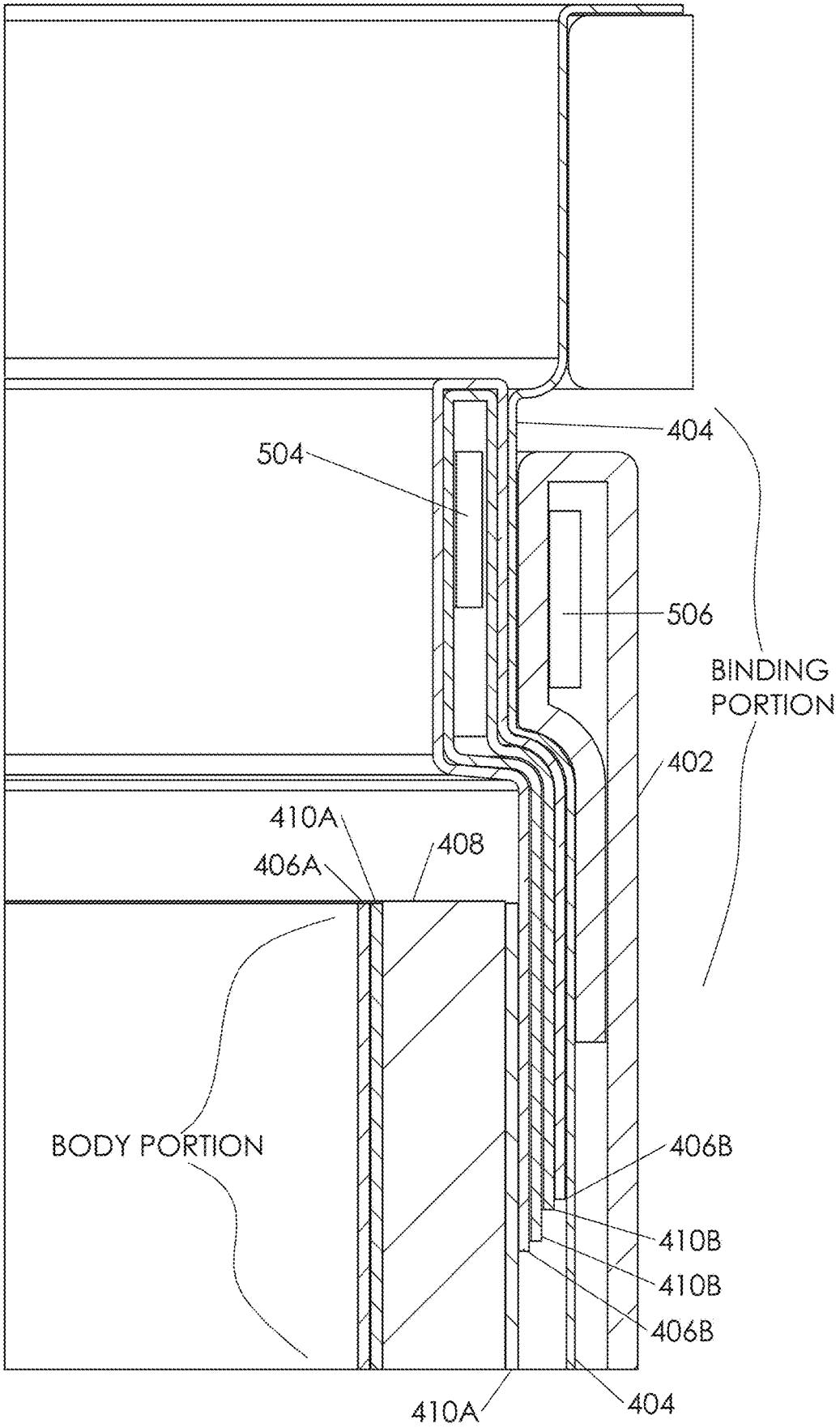
FIG. 6 illustrates a plurality of layers in a flexible body.

FIG. 6 shows an arrangement in which the flexible body 400 has two different portions that are joined together, which may be referred to as a binding portion and a body portion. In particular, a lower portion of the flexible body 400 is a body portion that comprises a first liner layer 406A, a first puncture resistant layer 410A and an energy absorbing layer 408. Here, the first puncture resistant layer 410A is arranged on both sides of the energy absorbing layer 408. Such an arrangement may be accomplished by folding a single piece of puncture resistant fabric over an end of the energy absorbing layer. Alternatively, two separate fabric layers are provided, and a laminate of multiple layers may be provided. In some embodiments, only one puncture resistant layer 410A is present The binding portion includes a second liner layer 406B and a second puncture resistant layer 410B. First and second ends of both of these layers overlap with and are joined to the body portion 410, e.g. by a stitched seam that may be sealed. The second liner layer 406B and puncture resistant layer 410B may be stitched to the outermost puncture resistant layer 410A, or stitched to a combination of layers comprising the body portion. As seen in FIG. 6, the layers of the binding portion are folded over first upper compression band 504, which compresses the layers to the orifice ring 300. In some embodiments, the material for first liner 406A may be different from 406B, and the material for puncture resistant layer 410A may be different from 410B, e.g. layer 410 may be thicker than 410B.

Using a separate binding portion and body portion may allow a thicker energy absorbing layer 408 to be entirely disposed below the orifice ring 300 in a compact arrangement. When the top of energy absorbing layer 408 terminates at the bottom surface of orifice ring 300, it may be more difficult for liquids or shards of a broken vessel to work their way upwards towards into the channel 306, the container may be more compact, and it may be easier to assemble the container. In such an embodiment, the ends of one or more layers of the body portion may be adhesively coupled to the base of orifice ring 300.

In another embodiment, layers of the binding portion of the flexible body 400 are disposed on both sides of the body portion. In particular, with respect to the perspective of FIG. 6, the layers on the left side of the first compression band 504 may be disposed on a left side of the body portion, e.g. on the left side of first liner 406A, while the layers disposed on the right side of first compression band 504 may be disposed on the right side of the body portion, e.g. the right side of first puncture resistant layer 410A. In such an embodiment, layers of the binding portion are disposed on both sides of the body portion. The body portion may be shifted outwards, or to the right side of FIG. 6, to accommodate such an arrangement. In either event, waterproof barrier layer 404 is disposed outside of the puncture resistant and liner layers so that the puncture resistant layers protect the waterproof barrier layer from sharp objects inside the container.

In some embodiments, leakproofness of a container is enhanced by providing a combination of sealing mechanisms. In the embodiment shown in FIG. 6, a seal is provided by a combination of compression of a waterproof layer 404 by compression band 506, compression of additional layers by compression band 504, and a tortuous path of the various layers. For example, in the view shown in FIG. 6, waterproof barrier layer 404 changes orientation by about 90 degrees four times, and puncture resistant layer 410B changes direction by about 90 degrees six times. In some embodiments, a tortuous path for a layer comprises two or more bends of at least 45 degrees, or four or more bends of at least 60 degrees.

Figure 7:
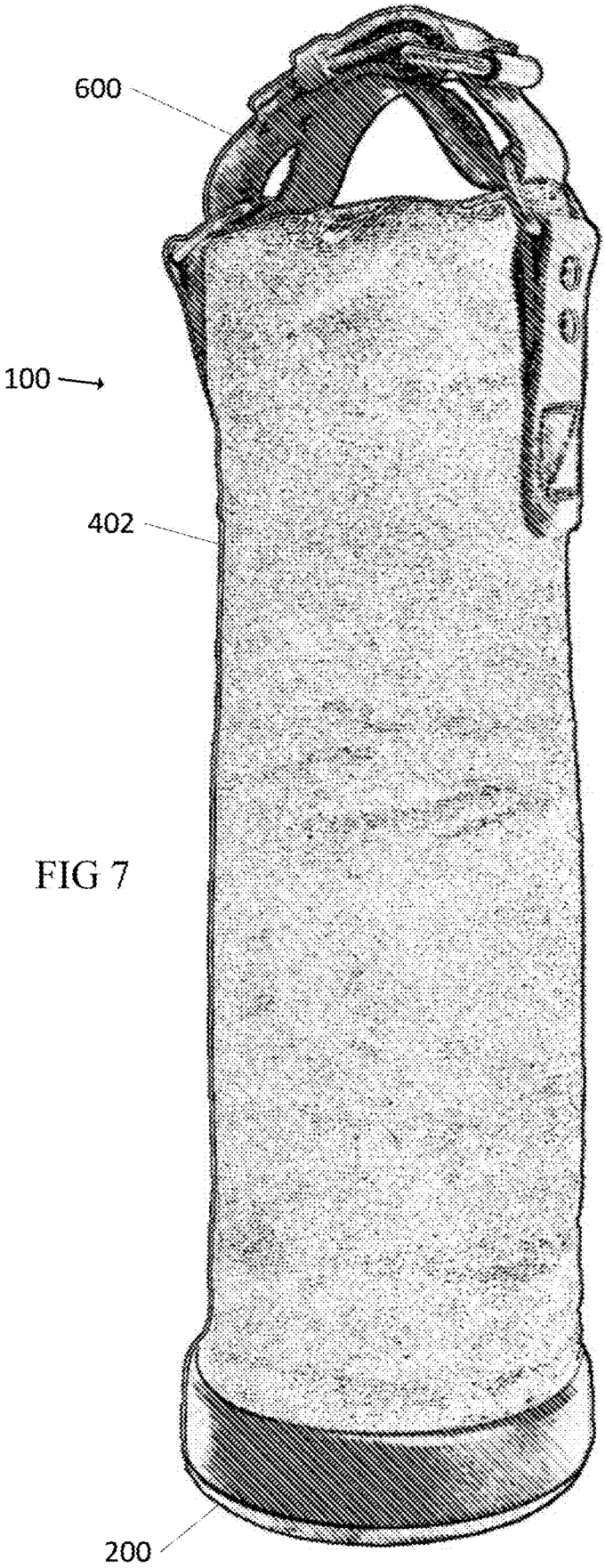
FIG. 7 illustrates an outer view of a container with a strap.
Figure 8:
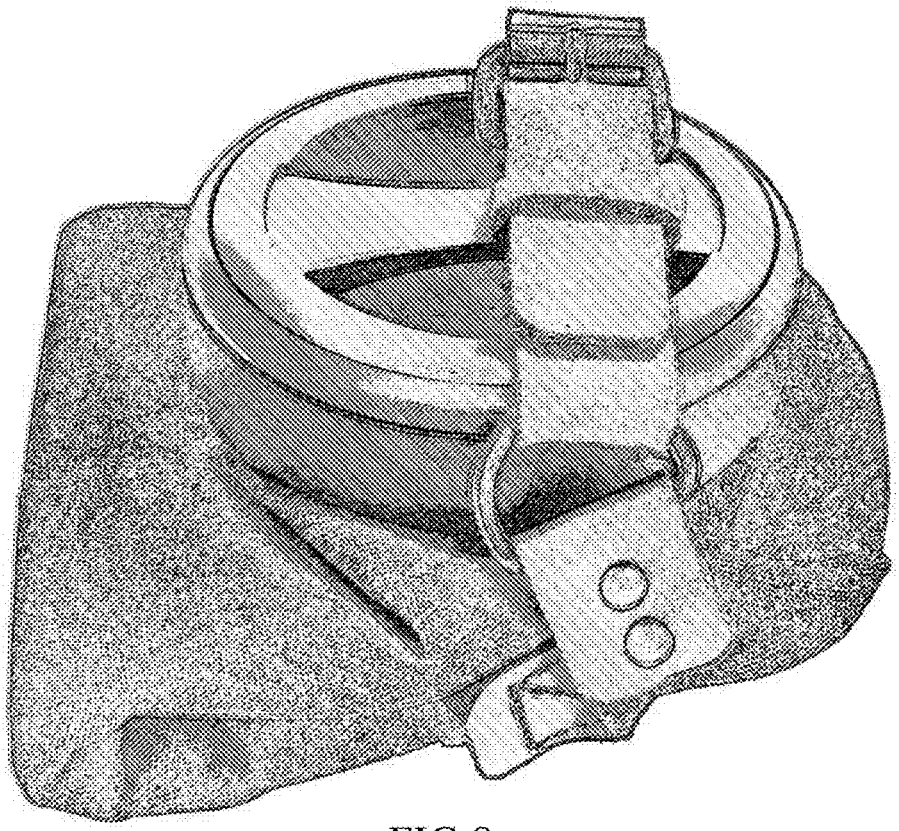
FIG. 8 illustrates an outer view of a container in a folded and strapped orientation.
Figure 9:
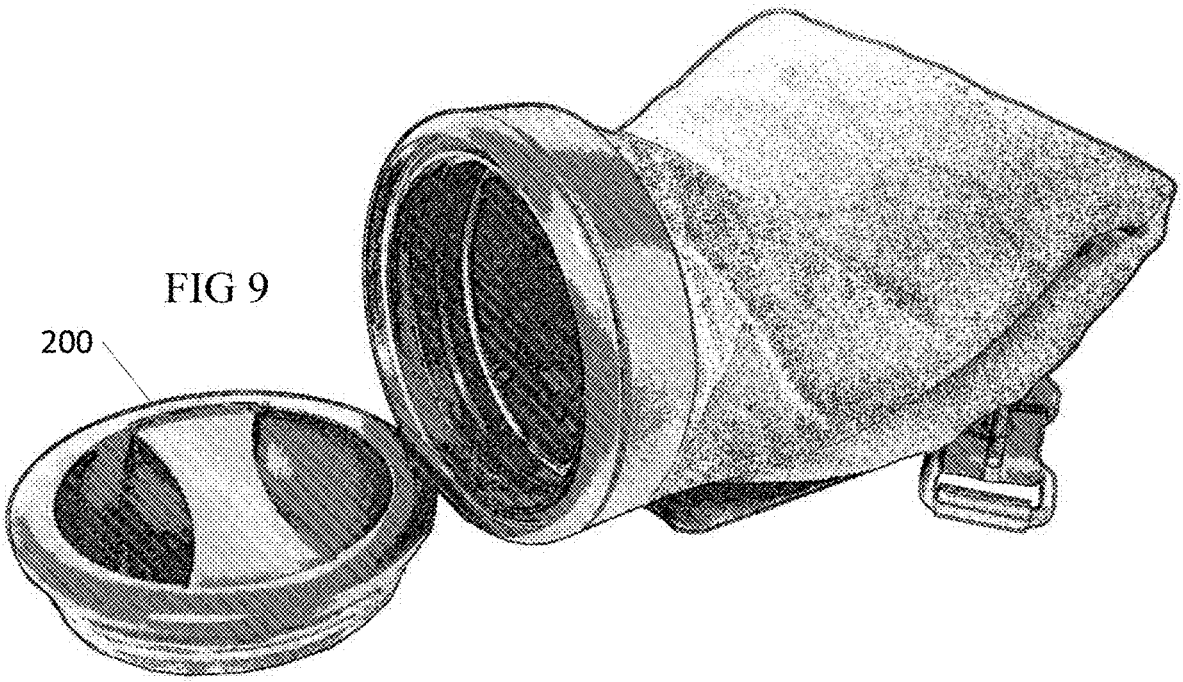
FIG. 9 illustrates an outer view of a container folded in half with the lid removed.

FIG. 7 shows an embodiment of a container 100 with a strap 600 attached to the outer layer 402 of the container. The strap 600 is attached to one end of the flexible body 400, so that it can be fastened over the lid 200 to maintain a compact configuration, as shown in FIG. 8. Different arrangements of strap 600 are possible—for example, the strap may be detachable, the pull mechanism may be a friction fit, and the strap may include loose ends that are meant to be tied in a knot. In an embodiment, a strap is provided to facilitate maintaining the flexible body 400 in a rolled configuration. FIG. 9 shows the dame embodiment as FIG. 9 in a partially folded orientation (folded in half) with lid 200 removed.

In addition, strap 600 may serve as a handle for transporting the container 100. FIG. 7 shows an advantage of having a strap 600 coupled to one end of the container 100 and the lid being disposed on an opposite end of the container, which is that the lid provides a stable base for a vessel when a user carries the container by the strap. In combination with the flat planar surface of the lid, the bumper 210, and the several layers of the flexible body 400, the container is well suited to transporting a glass vessel while minimizing the chance that the vessel would break and insulating from the elements. Accordingly, the embodiment of FIG. 7 is well suited, for example, for transporting a chilled bottle of wine to a picnic. When it is used to transport a vessel by the strap 600, the second protrusion 310 is especially useful for retaining the flexible body 400 to the orifice ring 300. For example, in the embodiment of FIG. 5, compression band 504 is inset from second protrusion 310, so second protrusion 310 effectively forms a lip that prevents compression band 504 from slipping off of the orifice ring 300.

The unique combination of features described by the present disclosure provide a container that is well suited to transporting a fragile vessel. A container according to an embodiment may provide a high degree of leakproofness in a lightweight and flexible form. The container may be flexible enough to be folded one or more times, or rolled into a compact shape that can be retained by a strap and occupies minimal space in a user's luggage.

The container may include a puncture resistant layer disposed inside of a waterproof barrier layer, and the waterproof barrier layer may be compressed at multiple positions to create an excellent seal. Accordingly, even when a fragile vessel such as a wine bottle breaks within the container within a suitcase and the suitcase is roughly handled, the container may prevent the wine from leaking out into the suitcase and contaminating a user's luggage. In addition, the combination layers may provide thermal insulation for a vessel.

Embodiments of the present disclosure may be useful to transport wine, and have qualities that have never been combined in a wine tote, including impact resistance, puncture resistance, waterproofness, flexibility and light weight for superior portability. Embodiments provide a flexible, compact container that not only has impact resistance, but has puncture resistance to provide a portable and leakproof container.

What is claimed is:

1. A collapsible leakproof container comprising:
- an orifice ring defining a mouth of the container;
- a lid that detachably seals with the orifice ring; and
- a flexible body coupled to the orifice ring, the flexible body comprising:
  - a body portion that comprises an energy absorbing layer and a puncture resistant layer, wherein an upper edge of the energy absorbing layer is disposed below a lower surface of the orifice ring;
  - a binding portion that comprises a second puncture resistant layer, is coupled to the body portion, and is retained to the orifice ring above the body portion;
  - an outer layer disposed over the binding portion; and
  - a waterproof barrier layer disposed inside the outer layer and sealed to the orifice ring.

2. The leakproof container of claim 1, wherein the energy absorbing layer comprises an open cell viscoelastic foam.

3. The leakproof container of claim 2, further comprising a first liner layer as an innermost layer.

4. The leakproof container of claim 1, wherein the body portion further comprises a first liner layer as an innermost layer of the body portion.

5. The leakproof container of claim 1, wherein the binding portion is retained to the orifice ring by one or more compression band, and the binding portion is coupled to the body portion by at least one of a stitching and an adhesive.

6. The leakproof container of claim 1, wherein the puncture resistant layer comprises an aramid or para-aramid polymer.

7. The leakproof container of claim 6, wherein the puncture resistant layer is an aramid or para-aramid felt.

8. The leakproof container of claim 1, wherein a channel is disposed on an outer surface of the orifice ring, and at least one layer of the flexible body is retained in the channel by at least one compression band.

9. The leakproof container of claim 8, further comprising a cover ring that covers the channel and the at least one compression band.

10. The leakproof container of claim 1, further comprising a first seal that seals the lid to the orifice ring, and a second seal that seals the waterproof barrier layer to the orifice ring.

11. The leakproof container of claim 10, wherein the waterproof barrier layer is compressed by the second seal.

12. The leakproof container of claim 1, further comprising:
- an elastomeric sealing element; and
- a cover ring coupled to the orifice ring and covering a free end of the waterproof barrier layer,
- wherein the waterproof barrier layer is disposed over the elastomeric sealing element, and the elastomeric sealing element is compressed between the cover ring and the orifice ring.

13. The leakproof container of claim 12, wherein the orifice ring comprises a shoulder that extends outward from the mouth and protrudes further than the sidewalls forming the channel, and
- wherein the cover ring is coupled to a lower surface of the shoulder.

14. The leakproof container of claim 1, wherein the leakproof container has a cylindrical shape and the orifice ring is disposed at one end of the cylindrical shape.

15. The leakproof container of claim 1, further comprising a strap configured to retain the flexible body in a collapsed state.

16. The leakproof container of claim 1, wherein the flexible body is flexible enough to be folded in half.

17. A foldable leakproof container comprising:
- an orifice ring defining a mouth of the container;
- a lid that detachably seals with the orifice ring, a bottom surface of the lid comprising an impact-absorbing material; and
- a flexible body coupled to the orifice ring, the flexible body comprising:
  - a body portion that comprises an energy absorbing layer and a puncture resistant layer, wherein an upper edge of the energy absorbing layer is disposed below a lower surface of the orifice ring;
  - a binding portion that comprises a second puncture resistant layer, is coupled to the body portion, and is retained to the orifice ring above the body portion;
  - an outer layer disposed over the binding portion; and
  - a waterproof barrier layer disposed inside the outer layer and sealed to the orifice ring.

18. The leakproof container of claim 1, wherein layers of the binding portion are retained to the orifice ring by a compression band and folded over the compression band.

* * * * *